US008214972B2

(12) United States Patent
Lai

(10) Patent No.: US 8,214,972 B2
(45) Date of Patent: Jul. 10, 2012

(54) CONTROL HANDLE OF A RETRACTABLE HANDLE ASSEMBLY FOR TRAVEL BAG

(76) Inventor: Wei-Hung Lai, Taichung (TW)

( * ) Notice: Subject to any disclaimer, the term of this patent is extended or adjusted under 35 U.S.C. 154(b) by 572 days.

(21) Appl. No.: 12/385,180

(22) Filed: Apr. 1, 2009

(65) Prior Publication Data

US 2010/0251517 A1 Oct. 7, 2010

(51) Int. Cl.
*A47B 95/02* (2006.01)

(52) U.S. Cl. ..... 16/113.1; 16/405; 16/427; 16/429; 190/39

(58) Field of Classification Search ..... 16/113.1, 16/114.1, 405, 421, 425, 427, 429, DIG. 19; 190/39, 115; 280/655, 655.1
See application file for complete search history.

(56) References Cited

U.S. PATENT DOCUMENTS 5,502,876 A * 4/1996 Wang ..... 16/113.1
5,553,350 A * 9/1996 Chang ..... 16/113.1
5,630,250 A * 5/1997 Chou ..... 16/113.1
5,781,965 A * 7/1998 Lu ..... 16/113.1
5,816,375 A * 10/1998 Tu ..... 190/115
5,864,921 A * 2/1999 Chou ..... 16/405
5,876,048 A * 3/1999 Lee ..... 280/47.315
5,926,914 A * 7/1999 Kuo ..... 16/405
5,970,579 A * 10/1999 Lu ..... 16/405
5,996,177 A * 12/1999 Cheng ..... 16/113.1
6,226,834 B1 * 5/2001 Lu ..... 16/113.1
6,397,436 B1 * 6/2002 Wang ..... 16/445
6,550,102 B1 * 4/2003 Liang ..... 16/113.1
2003/0009848 A1 * 1/2003 Kuo ..... 16/113.1
2003/0042092 A1 * 3/2003 Wang ..... 190/115

* cited by examiner

*Primary Examiner* — Victor Batson
*Assistant Examiner* — Roberta Delisle
(74) *Attorney, Agent, or Firm* — Rosenberg, Klein & Lee

(57) ABSTRACT

A control handle of a retractable handle assembly for travel bag is disclosed to include two control rods pivotally mounted in a base member and supported on respective compression springs, two control buttons respectively affixed to the control rods and suspending in a respective opening of a top cover being covered on the base member for operation by the user to unlock inner tubes to outer tubes, and a rotary grip formed of a top semicircular shell and a bottom semicircular shell and rotatable relative to the base member and the top cover; and two torsional springs mounted in the base member and connected with respective two opposite ends to the top semicircular shell and bottom semicircular shell of the rotary grip.

1 Claim, 5 Drawing Sheets

CONTROL HANDLE OF A RETRACTABLE HANDLE ASSEMBLY FOR TRAVEL BAG

BACKGROUND OF THE INVENTION

1. Field of the Invention

The present invention relates to a retractable handle assembly for travel bag and more particularly to a control handle for retractable handle that provides holding comfort to the user when the user is pulling the travel bag in a tilted position.

2. Description of the Related Art

A conventional retractable handle assembly for travel bag, as shown in FIG. 1, comprises two outer tubes 1 affixed to the frame structure of a travel bag in a parallel manner, two inner tubes 2 respectively slidably inserted into the outer tubes 1, and a handle 3 transversely connected between the top ends of the inner tubes 2. The handle 3 comprises a bottom cover shell 4, a top cover shell 5, and a control button 6. The control button 6 controls locking/unlocking of the inner tubes 2. This design of retractable handle assembly has drawbacks as follows:

1. The control button 6 is located on the middle of the handle 3. When a user is holding the handle 3, he (she) may press the control button 6 to unlock the inner tubes 2 accidentally.

2. Because the bottom cover shell 4 and the top cover shell 5 have a rectangular configuration and are not rotatable, the user's hand will feel uncomfortable when pulling the travel bag in an oblique condition.

SUMMARY OF THE INVENTION

The present invention has been accomplished to provide a control handle for a retractable handle assembly for travel bag, which eliminates the drawbacks of the aforesaid prior art design.

The control handle has two control buttons respectively suspending in two openings at two distal ends of a base member thereof for operation by a user to lock the inner tubes to the outer tubes or to unlock the inner tubes from the outer tubes.

Further, the control handle has a rotary grip formed of a top semicircular shell and a bottom semicircular shell and rotatable relative to the base member to provide holding comfort to the user when the travel bag is tilted. Further, two torsional springs are mounted in the base member of the control handle and connected with respective two opposite ends to the top semicircular shell and bottom semicircular shell of the rotary grip for reversing the rotary grip when the user released the pressure.

DETAILED DESCRIPTION OF THE PREFERRED EMBODIMENT

Figure 1:
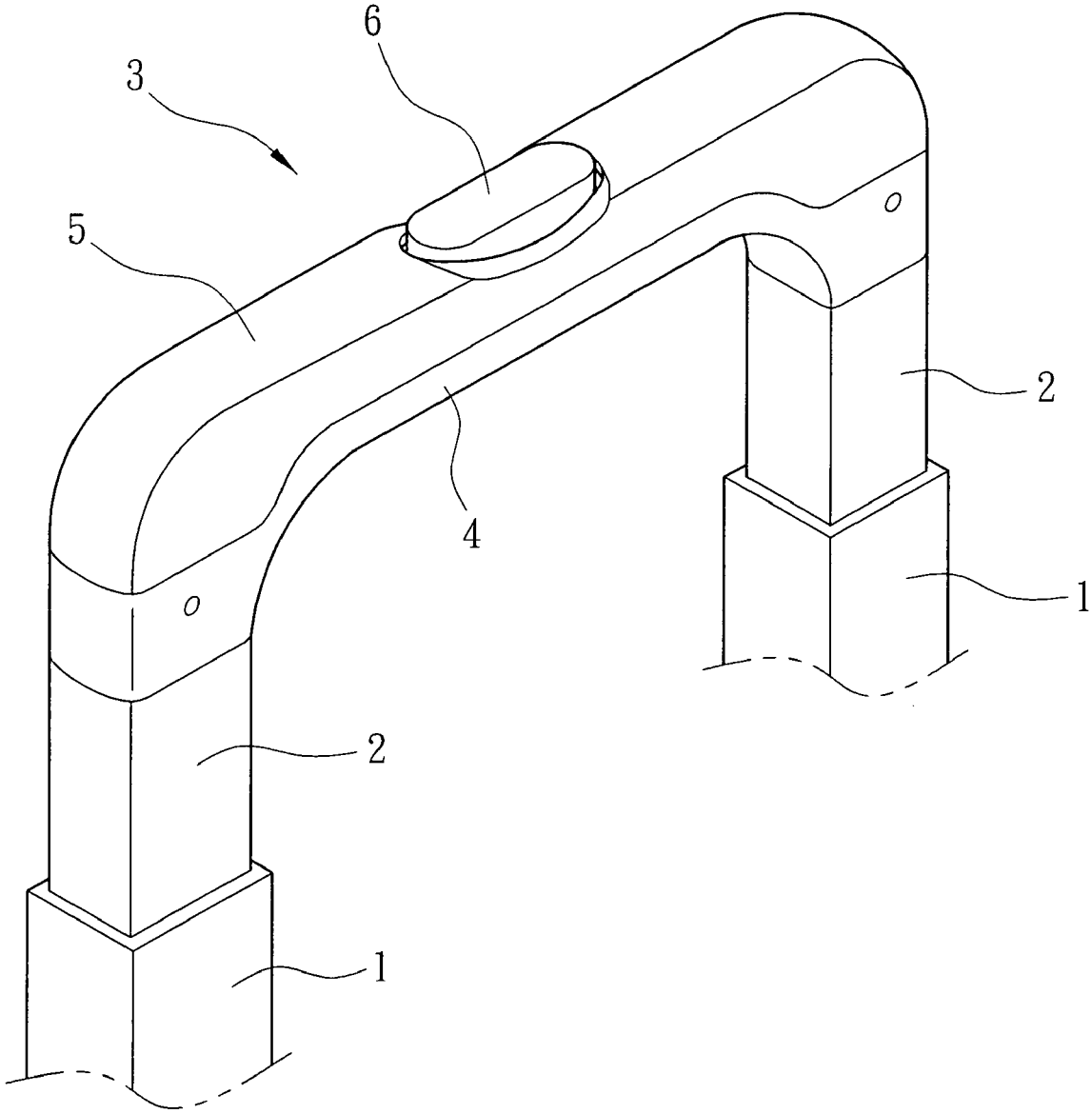
FIG. 1 PRIOR ART
FIG. 1 illustrates the structure of a retractable handle assembly for travel bag according to the prior art.
Figure 2:
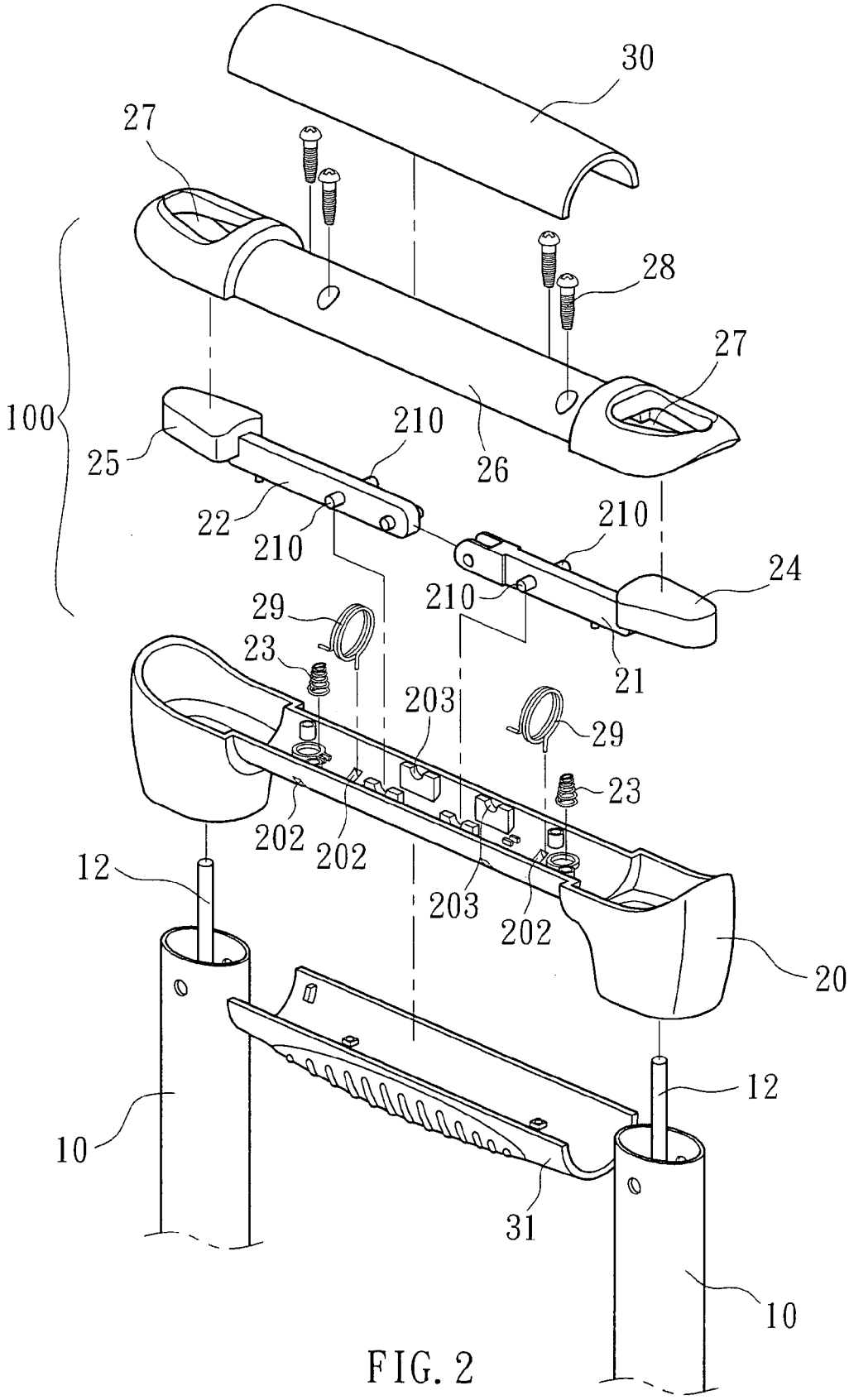
FIG. 2 is an exploded view of a retractable handle assembly for travel bag constructed according to the present invention.
Figure 3:
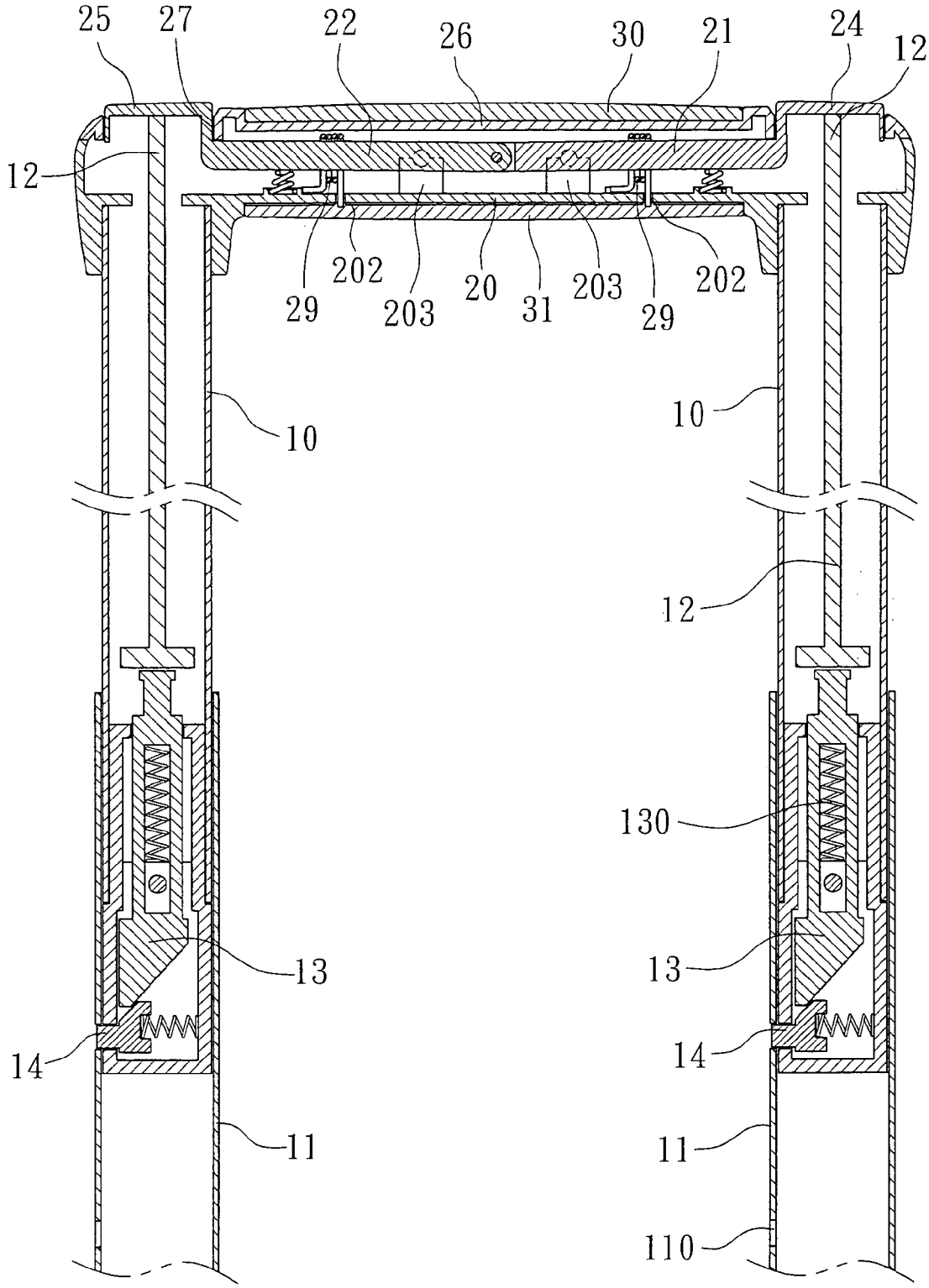
FIG. 3 is a sectional assembly view of the retractable handle assembly according to the present invention.
Figure 4:
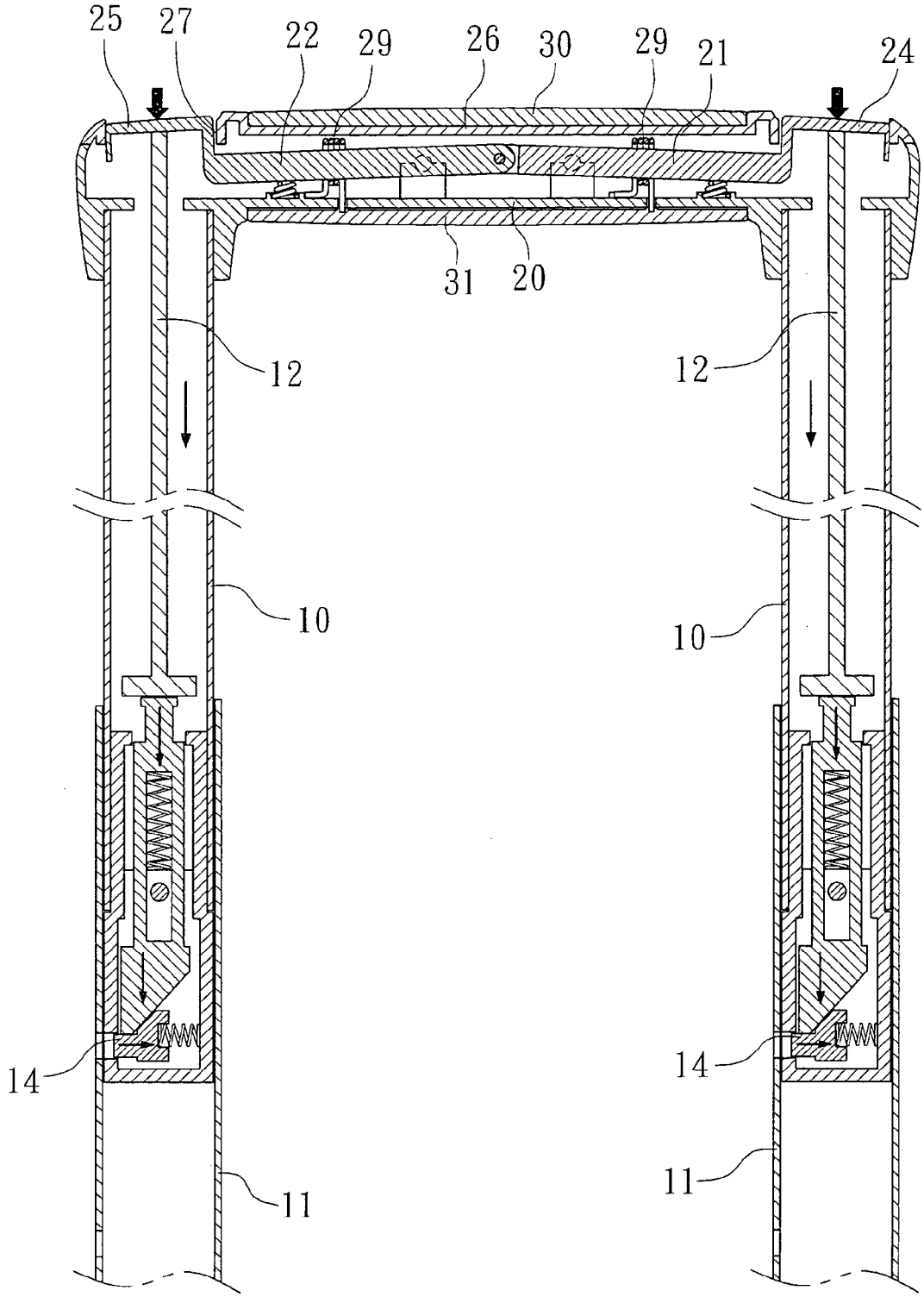
FIG. 4 corresponds to FIG. 3, showing the control buttons pressed, the inner tubes unlocked from the outer tubes.

Referring to FIGS. 2~6, a retractable handle assembly for travel bag is shown comprising two outer tubes 11 affixed to the frame structure of a travel bag (not shown) in a parallel manner, two inner tubes 10 respectively slidably inserted into the outer tubes 11, and a handle 100 transversely connected between the top ends of the inner tubes 10. The handle 100 comprises a base member 20, a top cover 26, two control buttons 24 and 25, a top semicircular shell 30, and a bottom semicircular shell 31. Further, two links 12 are respectively slidably mounted in the inner tubes 10 and respectively inserted with the respective top ends thereof into the two distal ends of the base member 20. The base member 20 is a narrow, elongated, hollow member having a plurality of pivot holders 203 and elongated slots 202. Two control rods 21 and 22 are respectively fixedly connected to the control buttons 24 and 25. Each control rod 21 or 22 has two pivot pins 210 aligned at two sides and pivotally coupled to one symmetrical pair of the pivot holders 203 in the base member 20. The control buttons 24 and 25 are respectively stopped at the top ends of the links 12. Further, two compression springs 23 are mounted inside the base member 20 and stopped against the control rods 21 and 22 to impart an upward pressure to the control buttons 24 and 25. The top cover 26 is covered on the base member 20 and fixedly fastened thereto with screws 28, having two openings 27 respectively located on the two distal ends thereof for accommodating the control buttons 24 and 25. The top semicircular shell 30 and the bottom semicircular shell 31 are fixedly connected together around the base member 20 and the top cover 26. Thus, the top semicircular shell 30 and the bottom semicircular shell 31 form a rotary grip. Further, two torsional springs 29 are mounted in the base member 20 with the respective two opposite ends respectively inserted through the elongated slots 202 and respectively fastened to the top semicircular shell 30 and the bottom semicircular shell 31 so that the grip of the top semicircular shell 30 and bottom semicircular shell 31 will be automatically reversed to its former position after having been rotated through an angle relative to the base member 20 and the top cover 26.

When the control buttons 24 and 25 are pressed to lower the links 12, the control rods 21 and 22 are biased to compress the compression springs 23. When the links 12 are lowered, two beveled blocks 13 are respectively forced by the links 12 to move respective locking pins 14 backwards from locating holes 110 of the outer tubes 11, thereby unlocking the inner tubes 10 for free sliding relative to the outer tubes 11. When the user released the hands from the control buttons 24 and 25, the compression springs 23 immediately return the control rods 21 and 22, and therefore the control buttons 24 and 25 are returned to their former position, and the respective return springs 130 return the respective beveled blocks 13 and the links 12.

Figure 5:
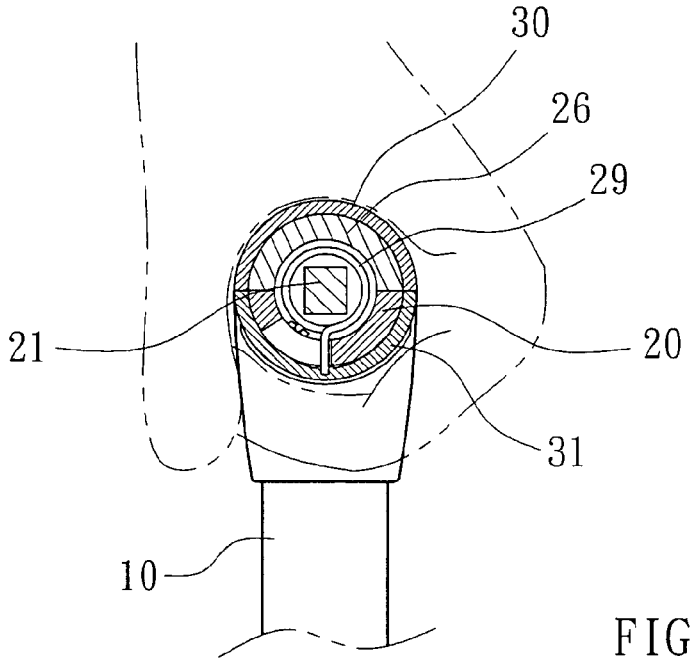
FIG. 5 is a schematic cross-sectional view of the present invention, showing the position of the grip of the top semicircular shell and bottom semicircular shell relative to the base member and the top cover.
Figure 6:
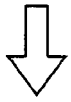
FIG. 6 corresponds to FIG. 5, showing the grip of the top semicircular shell and bottom semicircular shell rotated relative to the base member and the top cover.
Figure 6:
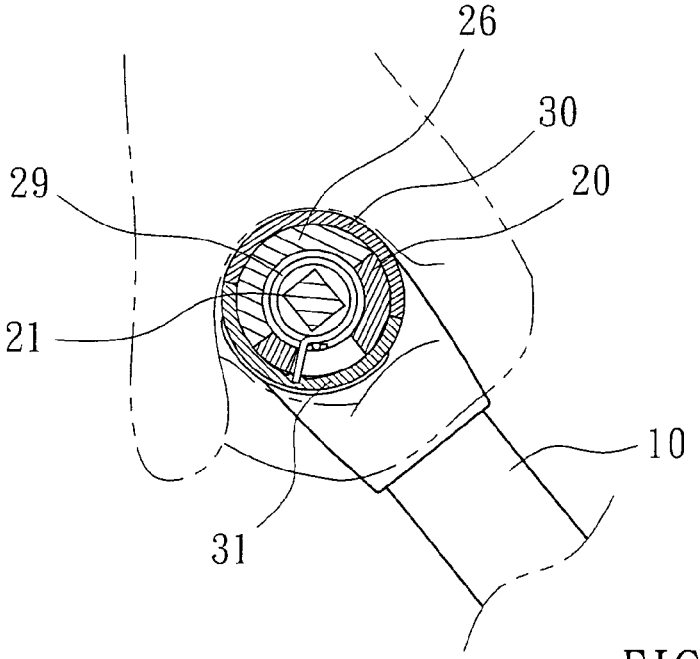

Further, when the user holds the grip of the top semicircular shell 30 and bottom semicircular shell 31 and keep the travel bag (not shown) in vertical, the torsional springs 29 are not twisted (see FIG. 5). When the user holds the grip of the top semicircular shell 30 and bottom semicircular shell 31 and tilts the travel bag, the grip of the top semicircular shell 30 and bottom semicircular shell 31 is rotated relative to the base member 20 and the top cover 26 to twist the torsional springs

29. Therefore, the user can pull the travel bag on the floor smoothly and comfortably. When the travel bag is returned from the tilted position to vertical, the twisted torsional springs 29 release the energy to reverse the grip of the top semicircular shell 30 and bottom semicircular shell 31 relative to the base member 20 and the top cover 26.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A retractable handle assembly, comprising two outer tubes affixed to the frame structure of a travel bag in a parallel manner, two inner tubes respectively slidably inserted into said outer tubes, two links inserted through said inner tubes, and a control handle transversely connected between said inner tubes outside said travel bag and controllable to move said links axially relative to said inner tubes between a locking position where said inner tubes are locked to said outer tubes and an unlocking position where said inner tubes are unlocked from said outer tubes, wherein said control handle comprises:

a base member, said base member comprising a plurality of pivot holders and a plurality of elongated slots;

a top cover covering said base member, said top cover comprising two openings respectively located on two distal ends thereof;

a grip surrounding said base member and said top cover and formed of a top rotatable semicircular shell and a bottom rotatable semicircular shell forming a sleeve around said base member and said top cover; said grip being rotatable relative to said base member and said top cover;

two control rods pivotally supported on said pivot holders inside said base member and coupled together;

two control buttons respectively affixed to one end of each of said control rods and respectively supported on said links in the openings of said top cover for operation by a user to move said links between said locking position and said unlocking position;

two compression springs mounted inside said base member and stopped against said control rods and adapted to support said control rods and said control buttons in said locking position; and two torsional springs mounted in said base member, each said torsional spring having a distal end extended out of said base member through each of said elongated slots respectively and connected to said bottom rotatable semicircular shell of said grip.

* * * * *